US010695896B2

(12) United States Patent
Ikuta

(10) Patent No.: US 10,695,896 B2
(45) Date of Patent: Jun. 30, 2020

(54) POWER SCREWDRIVERS

(71) Applicant: MAKITA CORPORATION, Anjo-shi, Aichi (JP)

(72) Inventor: Hiroki Ikuta, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 196 days.

(21) Appl. No.: 15/897,711

(22) Filed: Feb. 15, 2018

(65) Prior Publication Data

US 2018/0311801 A1 Nov. 1, 2018

(30) Foreign Application Priority Data

Apr. 26, 2017 (JP) ..... 2017-087172

(51) Int. Cl.
*B25B 23/00* (2006.01)
*B25F 5/00* (2006.01)
*B25B 21/00* (2006.01)

(52) U.S. Cl.
CPC ..... *B25B 23/0064* (2013.01); *B25B 21/00* (2013.01); *B25B 23/0028* (2013.01); *B25F 5/001* (2013.01); *B25F 5/003* (2013.01)

(58) Field of Classification Search
CPC ... B25B 23/0064; B25B 21/00; B25B 23/028; B25F 5/001; B25F 5/003
USPC ..... 173/18
See application file for complete search history.

(56) References Cited

U.S. PATENT DOCUMENTS 6,176,162 B1 * 1/2001 Ludwig ..... B25B 23/0064 81/467
8,418,778 B2 * 4/2013 Eshleman ..... B25B 21/00 173/1

FOREIGN PATENT DOCUMENTS

JP 2012-51086 A 3/2012

* cited by examiner

*Primary Examiner* — Michelle Lopez
(74) *Attorney, Agent, or Firm* — Oliff PLC

(57) ABSTRACT

A power screwdriver may include a main body including a bit drive device configured to rotate a driver bit. A screw may be attached to the driver bit. The power screwdriver may further include a locator attached to the main body and configured to adjust a driving depth of the screw into a workpiece. The locator may include a contact member including a contact surface for contacting with the surface of the workpiece. An orientation adjusting device may adjust the orientation of the contact member relative to the main body or the axial direction of the driver bit.

14 Claims, 8 Drawing Sheets

POWER SCREWDRIVERS

This application claims priority to Japanese patent application serial number 2017-087172, the contents of which are incorporated herein by reference.

BACKGROUND

Technical Field

Embodiments of the present disclosure relate to power screwdrivers, such as electric screwdrivers, used for driving screws into workpieces.

Description of the Related Art

Some of known electric screwdrivers have a locator attached to a housing of the screwdriver. The housing may accommodate a motor for rotating a driver bit. The rotation of the motor may be transmitted to the driver bit via a clutch device. For driving screws into a workpiece, such as a panel, a tip contact surface of the locator may be pressed against the workpiece, and in this state, a screw may be driven into the workpiece by the rotating bit. When the screw has been driven into the workpiece by a predetermined depth, transmission of rotation of the motor to the driver bit may be interrupted by the clutch device.

For example, JP-A-2012-51086 (also published as JP-B-5517845) discloses an electric screwdriver 101 having a locator 140 as shown in FIG. 10. In the electric screwdriver 101 of this publication, a contact surface 164*a* of the locator 140 for contacting a workpiece is covered by a rubber cap 164*c*. If no rubber cap 164 is provided, there is a risk that a surface of the workpiece is damaged in particular when the contact surface 164*a* contacts the surface of the workpiece only at a part of a peripheral edge 164*b* without contacting at the entire contact surface 164*a* (hereinafter called "a partial contact" of the contact surface 164*a*). Therefore, the rubber cap 164 can prevent potential damage, such as formation of a crescent-shaped depression, to the surface of the workpiece.

However, if the partial contact of the contact surface 164*a* via the rubber cap 164 is repeated many times, the contact portion of the rubber cap 164 may be worn. In such a case, it may be necessary to replace the rubber cap 164 with new one.

Therefore, there has been a need in the art for a power screwdriver that may not cause a potential damage to a workpiece by a locator without need of a rubber cap or any other cover member for covering the contact surface of the locator.

SUMMARY

In one aspect according to the present teachings, a power screwdriver may include a main body including a bit drive device configured to rotate a driver bit. A screw may be attached to the driver bit. The power screwdriver may further include a locator attached to the main body and configured to adjust a driving depth of the screw into a workpiece. The locator may include a contact member including a contact surface for contacting with the surface of the workpiece. An orientation adjusting device may adjust the orientation of the contact member relative to the main body or the axial direction of the driver bit.

DETAILED DESCRIPTION

Figure 1:
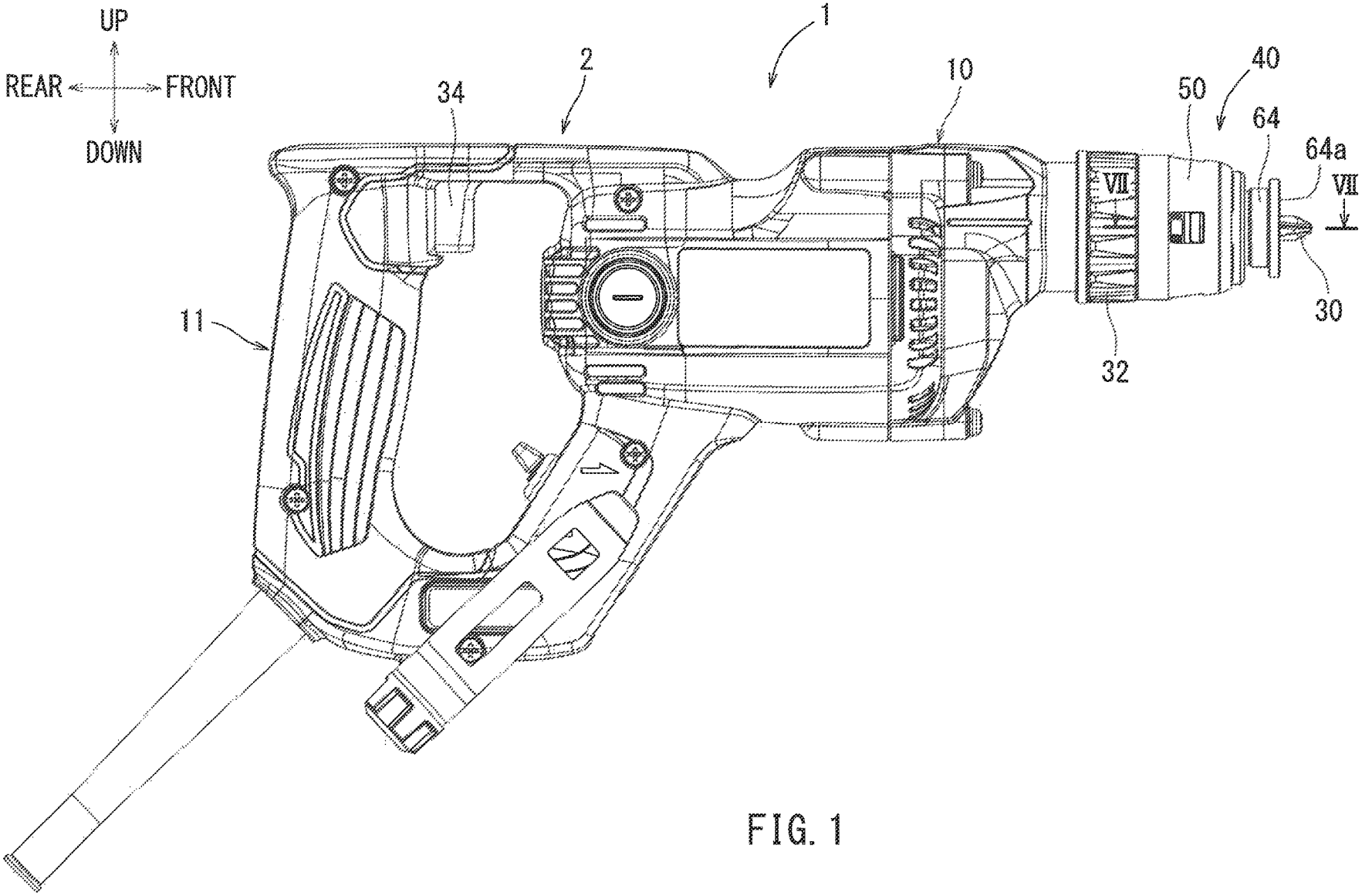
FIG. 1 is a side view of an electric screwdriver according to a representative embodiment.

In one embodiment, a power screwdriver may be an electric screwdriver having a main body that includes a housing. The electric screwdriver may further include a bit drive device and a locator. The bit drive device may include an electric motor disposed within the main body for rotating a driver bit. The driver bit may extend in an axial direction within the housing. A screw can be attached to the driver bit. The locator may be attached to the housing and may adjust a driving depth of the screw into a workpiece. The locator may include a contact member having a contact surface configured to contact the workpiece, so that the screw is driven into the workpiece by a predetermined depth determined by a position of the contact surface of the contact member relative to the driver bit in the axial direction. An angle variable device may vary an angle of the contact surface of the contact member relative to the axial direction of the driver bit.

Therefore, even in the case where the contact surface of the contact member of the locator contacts the workpiece in a partial contact manner for the first time, the contact surface may thereafter tilt, so that the entire contact surface may contact the workpiece. Hence, it is possible to prevent potential damage to the workpiece, such as formation of a crescent-shaped depression in the surface of the workpiece. Further, it is not necessary to provide a cover, such as a rubber cover, for covering the contact surface of the contact member.

The bit drive device may be further configured to interrupt transmission of rotation of the electric motor to the driver bit when the screw has been driven into the workpiece by the predetermined depth while the contact surface of the contact member is in contact with the workpiece.

The angle variable device may vary the angle of the contact surface of the contact member in any of directions about the axial of the driver bit.

Therefore, it may be possible to vary the angle of the contact surface of the contact member whichever direction the contact surface contacts the workpiece.

The locator may include a locator body structure and a contact member structure. The locator body structure may be attached to the housing of the main body. The contact member structure may include the contact member having the contact surface and may be coupled to the locator body structure via the angle variable device. The angle variable device may include a spherical convex surface structure and a spherical concave surface structure slidably contacting with each other along a spherical plane.

With this arrangement, the angle variable device may have a simple construction because it does not need a relatively complicated joint structure, such as a joint structure having two rotational axes extending perpendicular to each other.

The contact member structure may further include a support member that is coupled to the locator body structure via the angle variable device. The contact member may be detachably attached to the support member.

With this arrangement, the contact member may be replaced with another contact member, for example, when the contact member has been damaged.

The electric screw driver may comprise a plurality of contact members made from different materials from each other and selectively attached to the support member.

For example, the plurality of contact members may include a first contact member made from synthetic resin having a relatively high rigidity, a second contact member made from aluminum, a third contact member made from iron, and a fourth contact member made from synthetic resin having a relatively low rigidity, i.e., soft synthetic resin or rubber. By preparing these four contact members, one of these contact members may be selectively used depending on the purpose of use of the electric screwdriver.

The spherical convex surface structure of the angle variable device may be disposed at the contact member structure. The locator body structure may include a base and a holder. The spherical concave surface structure of the angle variable device may be disposed at the base. The spherical concave surface structure may include a plurality of spherical concave surface portions arranged in a circumferential direction of the base. The base may further include a plurality of engaging holes arranged alternately with the plurality of spherical concave surface portions in the circumferential direction. The holder may hold the contact member structure with respect to the base and may include a plurality of engaging claws configured to engage the plurality of engaging holes.

With this arrangement, the angle variable device may have a compact construction.

The electric screwdriver may further include an elastic holding device configured to elastically hold the contact member such that the contact surface of the contact member extends substantially perpendicular to the axial direction of the driver bit.

A representative embodiment will now be described with reference to FIGS. 1 to 9. Referring to FIG. 1, there is shown an electric screwdriver according to the representative embodiment. In the following description, up, down, front, rear, left and right directions will be determined on the basis of the illustration of the electric screwdriver 1 shown in FIG. 1.

Figure 2:
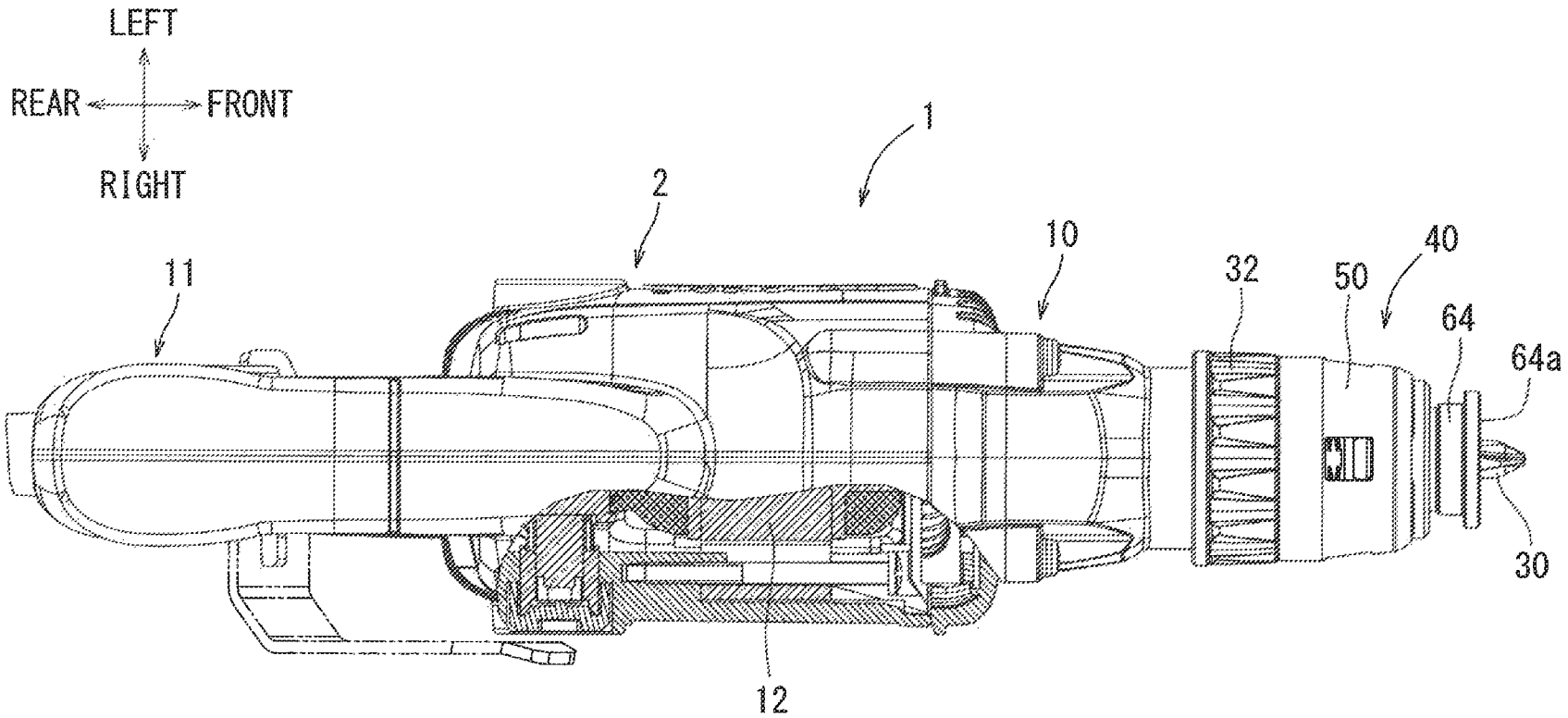
FIG. 2 a plan view, with a part shown in a horizontal sectional view, of the electric screwdriver.
Figure 3:
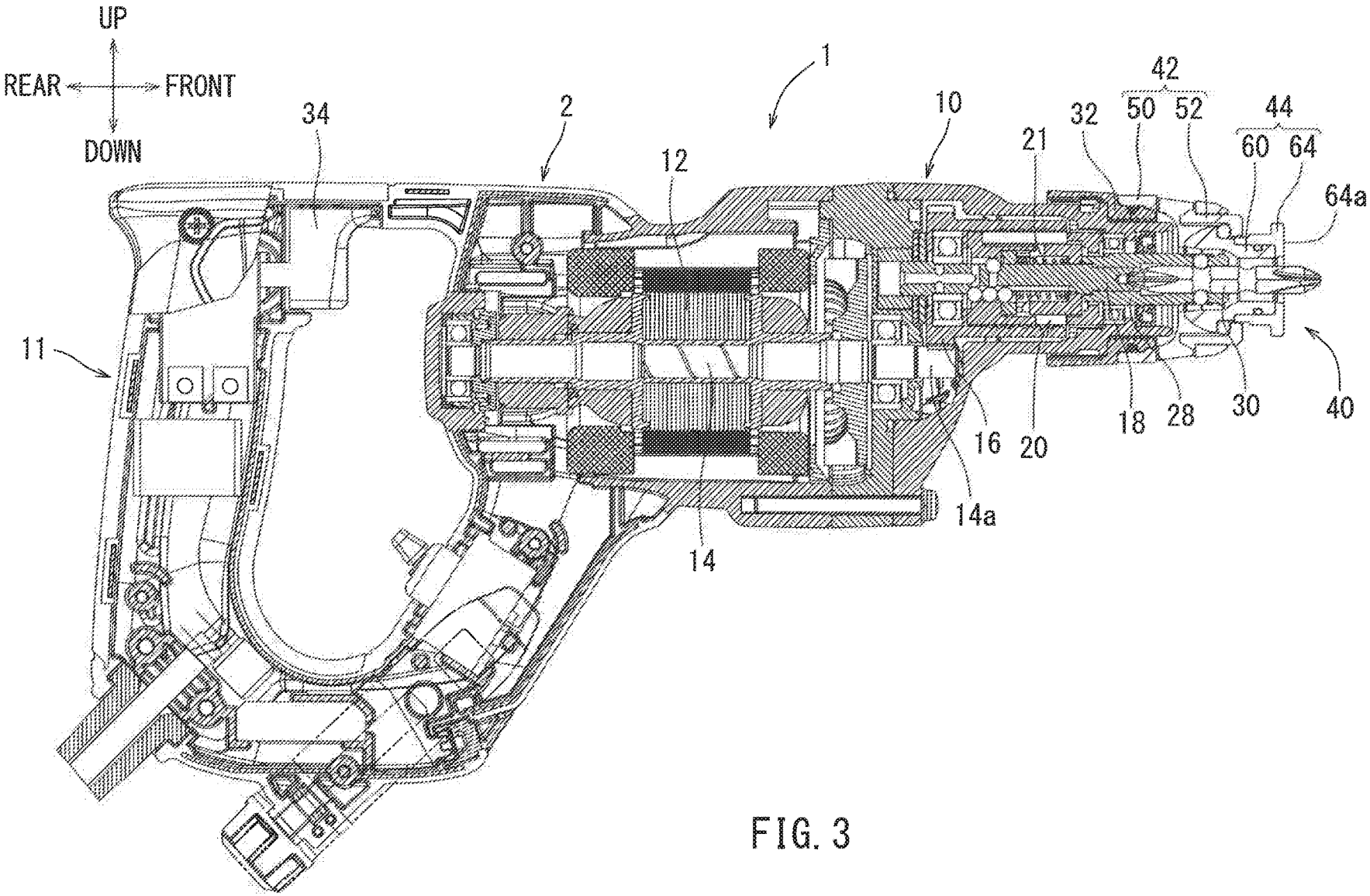
FIG. 3 is a vertical sectional view of the electric screwdriver.

Referring to FIGS. 1 to 3, the electric screwdriver 1 may include a main body 2 having a tubular housing 10 and a handle 11 disposed on the rear side of the housing 10. An electric motor 12, a clutch device 20 and a spindle 18 may be disposed within the housing 10. A trigger 34 may be disposed at the handle 11 and may be operable for starting and stopping the electric motor 12. The electric motor 12 may have a motor shaft 14 having a motor gear 14*a*. The motor gear 14*a* may engage a reduction gear 16 disposed within the housing 10 on the front side of the electric motor 14. The spindle 18 may be disposed on the front side of the reduction gear 16 and may be supported within the housing 10 such that the spindle 18 can rotate about an axis and is movable in front and rear directions. The clutch device 20 is disposed between the reduction gear 16 and the spindle 18, so that the rotation of the motor shaft 14 may be transmitted to the reduction gear 16 and further to the spindle 18 via the clutch device 20. A driver bit 30 is detachably attached to the front end of the spindle 18 via a chuck 28, so that the driver bit 30 can rotate together with the spindle 18 about the same axis as the spindle 18.

Because the driver bit 30 is attached to the spindle 18 via the chuck 27, various types (sizes) of driver bits can be interchangeably attached to the spindle 18 for use as the driver hit 30 according to the size of screws (not shown) to be driven.

The clutch device 20 is configured to transmit the rotation of the reduction gear 16 to the spindle 18 and to interrupt the transmission of the rotation depending on the position of the spindle 18 in the front-to-rear direction. More specifically, the clutch device 20 may interrupt the transmission of the rotation to the spindle 18 when the spindle 18 is positioned at a normal position in the front-to-rear direction. A spring 21 may be disposed within the clutch device 20 for applying a biasing force to the spindle 18, so that the spindle 18 can be held at the normal position. When the spindle 18 moves rearward from the normal position against the biasing force of the spring 21, for example, by being pressed against a workpiece via a screw to be driven, the clutch device 10 may transmit the rotation to the spindle 18 for driving the screw into the workpiece.

An adjusting ring 32 is threadably engaged with the outer surface of the front end of the housing 10. A locator 40 for adjusting a driving depth of a screw into a workpiece is attached to the front end of the adjusting ring 32. Therefore, as the adjusting ring 32 rotates, the locator 40 moves in the front-to-rear direction together with the adjusting ring 32 relative to the front end of the housing 10. In this way, it is possible to adjust the position in the front-to-rear direction by the operation of the adjusting ring 32, whereby a forwardly protruding distance of the driver bit 30 from the locator 40 can be adjusted.

Figure 4:
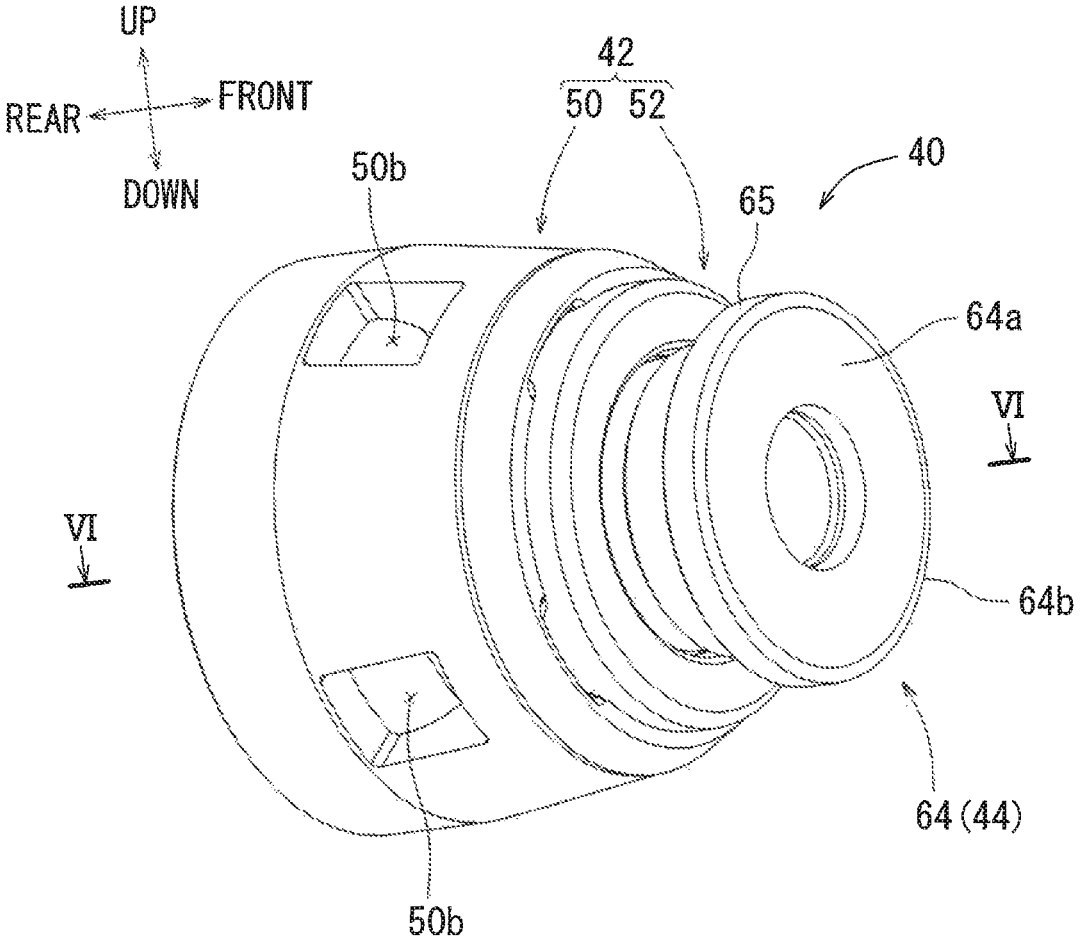
FIG. 4 is a perspective view of a locator attached to a housing of a main body of the electric screwdriver.
Figure 5:
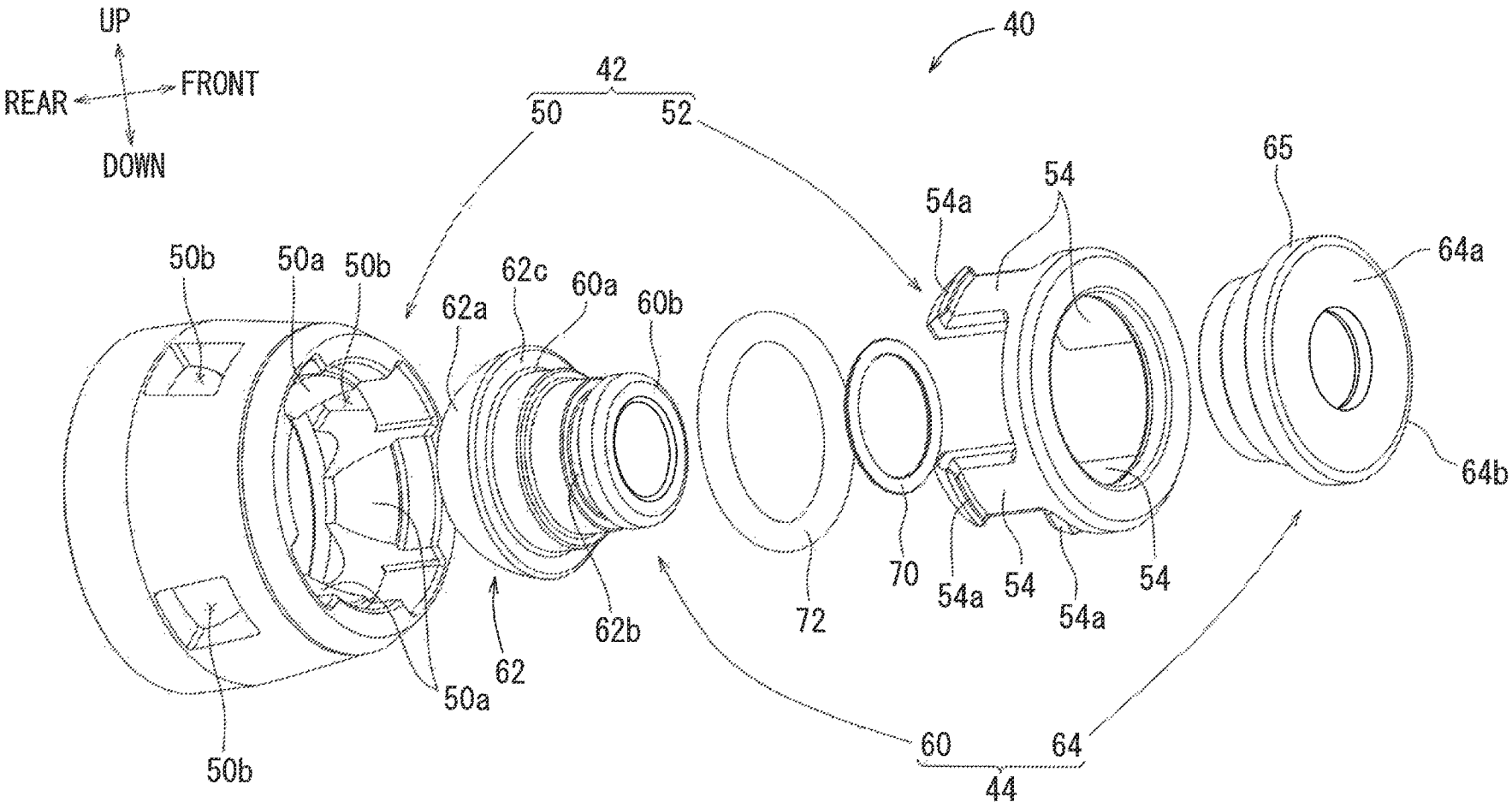
FIG. 5 is an exploded perspective view of the locator.

The locator 40 will now be described with reference to FIGS. 4 to 7. Referring to FIGS. 4 and 5, the locator 40 generally includes a locator body structure 42 and a contact member structure 44.

The locator body structure 42 may generally include a tubular base 50 and a ring-shaped holder 52. The base 50 is tapered toward the front side and includes a plurality of spherical concave surface portions 50*a* formed on the inner circumferential surface thereof. The plurality of spherical concave surface portions 50*a* corresponds to segments of a spherical surface. A plurality of engaging holes 50*b* are formed in the circumferential wall of the base 50 to extend threrethrough in the radial directions. The holder 52 serves to prevent removal of the contact member structure 44 from the base 50 as will be explained later.

In this embodiment, four spherical concave surface portions 50*a* are formed on the inner circumferential surface of the base 50 and are spaced equally from each other in the circumferential direction, i.e., by and angle of 90°. Further, in this embodiment, four engaging holes 50*b* are formed in the circumferential wall of the base 50 so as to be spaced equally from each other in the circumferential direction by an angle of 90°. More specifically, each of the engaging holes 50*b* is positioned between two adjacent spherical concave surface portions 50*a* in the circumferential direction. In this way, four spherical surface portions 50*a* and four engaging holes 50*b* are arranged alternately in the circumferential direction.

The holder 52 may have a plurality of elastically deformable extensions 54. The plurality of elastically deformable extensions 54 may extend rearward from a ring-shaped body of the holder 52 and may be spaced equally from each other in the circumferential direction. Each of the elastically deformable extensions 54 has an engaging claw 54*a* for engaging the corresponding one of the engaging holes 50*b* of the base 50. In this embodiment, four elastically deformable extensions 54 are provided and spaced from each other in the circumferential direction by an angle of 90° to correspond to the four engaging holes 50*b*. Each of the engaging claws 54*a* is tapered rearward to have an inclined surface inclined radially inward in the rear direction.

Figure 6:
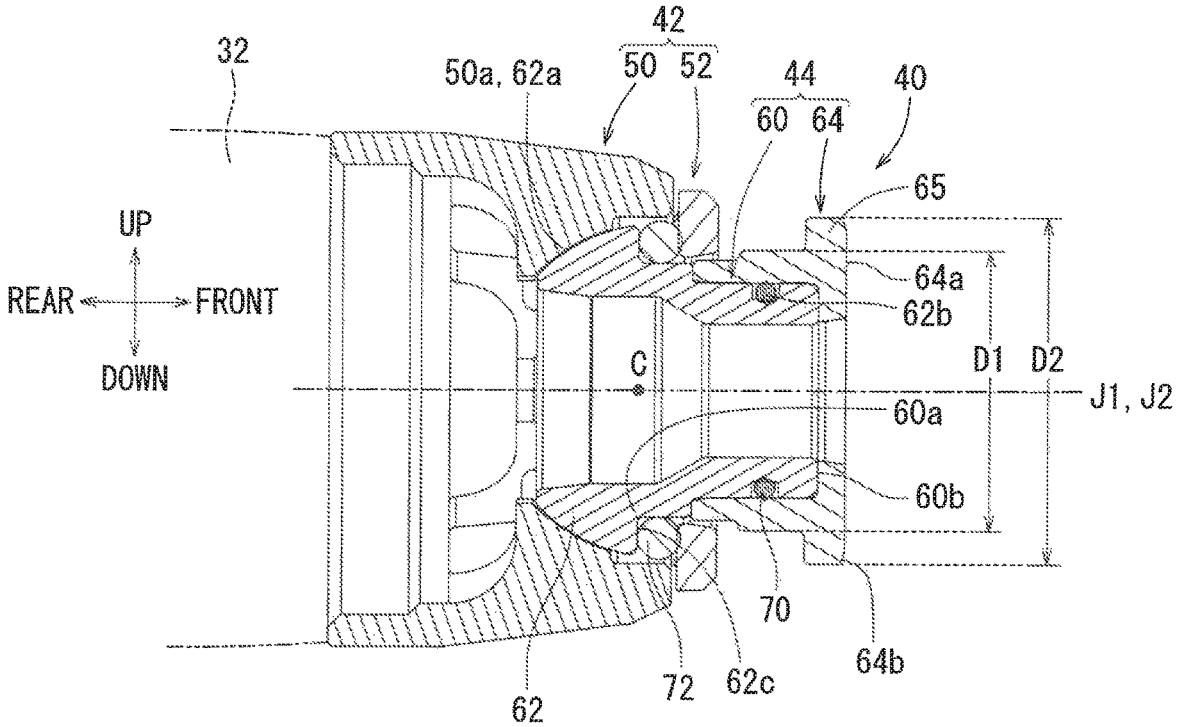
FIG. 6 is a sectional view of the locator taken along line VI-VI in FIG. 4.

The contact member structure 44 will now be described. As shown in FIG. 5, the contact member structure 44 may include a support member 60 and a contact member 64. The support member 60 may have a substantially cylindrical shape with a stepped outer surface. An enlarged portion 62 is formed on a rear end 60*a* of the support member 60. An annular stepped surface 62*c* is formed on the front side of the enlarged portion 62*a* for engaging an O-ring 72 made from an elastic material, such as rubber, polyurethane or sponge. The enlarged portion 62 may have a spherical concave surface 62*a* corresponding to a part of a spherical plane conforming to the spherical plane defining the plurality of spherical concave surface portions 50*a* of the base 50 as shown in FIG. 6. The spherical concave surface 62*a* may have a predetermined length in the axial direction (i.e., the front-to-rear direction) and may extend continuously in the circumferential direction. A circumferential groove 62*b* may be formed in the outer circumferential surface of the support member 60 at an intermediate position between the rear end 60*a* and a front end 60*b*. An O-ring 70 made from an elastic material similar to that of the O-ring 72 may be fitted into the circumferential groove 62*b* as shown in FIG. 6.

The contact member 64 has a substantially ring shape with a front end portion 65 enlarged like a flange. Therefore, as shown in FIG. 6, an outer diameter D2 of the front end portion 65 is larger than an outer diameter D1 of the remaining portion of the contact member 64. The contact member 64 may be made from a synthetic resin, such as polypropylene, having a relatively high rigidity. The front surface of the front end portion 65 is configured as a contact surface 64*a* for contacting a workpiece. The contact member 64 may be fitted on the front end 60*b* of the support member 60. The O-ring 70 fitted into the circumferential groove 62*b* of the support member 60 may elastically frictionally contact the inner circumferential surface of the contact member 64, so that it may be possible to prevent accidental removal of the contact member 64 from the support member 60. However, the contact member 64 can be removed from the support member 60, for example, by manually forcibly applying a removing force in the forward direction while the support member 60 is held in position. Therefore, if necessary or desired, the contact member 64 can be replaced with another contact member made from a different material or having a different shape or size from the contact member 64.

A representative method of assembling together the locator body structure 42 and the contact member structure 44 of the locator 40 will now be described. First, the support member 60 of the contact member structure 44 is inserted into the base 50 of the locator body structure 42 such that the spherical convex surface 62*a* contacts the plurality of spherical concave surface portions 50*a* of the base 50. Subsequently, the O-ring 72 is fitted on the support member 60 so as to engage the annular stepped surface 62*c* formed on the front side of the enlarged portion 62. After that, the holder 52 is fitted on the base 50 by moving the holder 52 rearward toward the base 50 in the axial direction while the engaging claws 54*a* of the elastically deformable extensions 54 are aligned with the engaging holes 50*b* formed in the base 50. As the holder 52 moves toward the base 50, the front end 60*b* of the support member 60 is inserted into the ring-shaped body of the holder 52. On the other hand, the plurality of elastically deformable extensions 54 having the engaging claws 54*a* of the holder 52 are inserted into an insertion space formed between the inner circumferential surface of the front portion of the base 50 and the O-ring 72 (see FIG. 7). As the plurality of elastically deformable extensions 54 are inserted into the insertion space, they may elastically deform radially inward due to contact of the inclined surfaces of the engaging claws 54*a* with the inner circumferential surface of the front end portion of the base 50. When the engaging claws 54*a* reach to positions opposing to the engaging holes 50*b* of the base 50, the elastically deformable extensions 54 may recover their shapes to move radially outward, so that the engaging claws 54*a* automatically engage the engaging holes 50*b* to hold the holder 52 in position relative to the base 50 (see FIG. 7). In this state, the rear surface of the ring-shaped body of the holder 52 may contact the front surface of the O-ring 72, so that the support member 60 can be prevented from being accidentally removed from the base 50 while the spherical convex surface 62*a* is held in contact with the plurality of spherical concave surface portions 50*a* of the base 50. In this way, the operation for assembling the locator body structure 42 and the contact member structure 44 together can be completed. The contact member 64 may be attached to the support member 60 before or after the assembling operation. In this state, the driver bit 30 attached to the spindle 18 may extend through the locator 40 while a front portion of the driver bit 30 protrudes forward from the contact surface 64*a* of the contact member 64.

Figure 7:
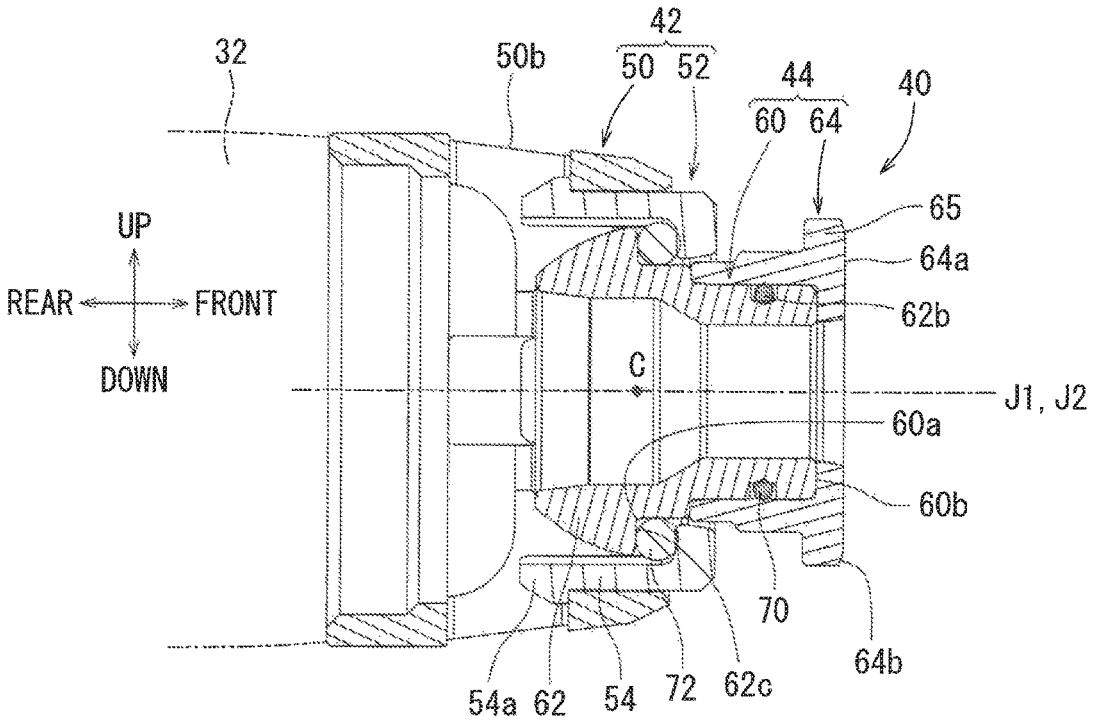
FIG. 7 is a sectional view of the locator similar to FIG. 6 but taken along line VII-VII in FIG. 1.

As described previously, the locator 40 may be attached to the operation ring 32 that is threadably engaged with the front end of the housing 10. In this embodiment, the front end of the housing 10 is coaxial with the spindle 18 and also with the driver bit 30 attached to the spindle 18, so that the operation ring 32, the base 50 of the locator 40 attached to the operation ring 32, and the holder 52 engaged with the base 50 are coaxial with the spindle 18. Further, the support member 60 and the contact member 64 attached to the support member 60 may be normally held to be coaxial with the spindle 18 by the O-ring 72. In FIGS. 6 and 7, J1 denotes the axis of the spindle 18 (i.e., the axis of the driver bit 30), and J2 denotes the axis of the contact member 64 (i.e., the axis of the support member 60).

In the electric screwdriver 1 described above, the contact surface 64*a* of the contact member 64 normally extends within a plane that is vertical to the axis J1 of the spindle 18 (i.e., the axis of the driver bit 30). Because the spherical convex surface 62*a* of the support member 60 slidably contacts the plurality of spherical concave surface portions 50*a* of the base 50, the contact member 64 can pivot together with the support member 60 about a center C of a spherical plane defining the spherical convex surface 62*a*, which coincides with a spherical plane defining the plurality of spherical concave surface portions 50*a* (see FIGS. 6 and 7). In this embodiment, the center C of the spherical plane is positioned on the axis J1 of the spindle 18 (i.e., the axis of the driver bit 30). Therefore, the contact member 64 can tilt together with the support member 60 such that the axis J2 of the contact member 64 is inclined relative to the axis J1 of the spindle 18 in any direction throughout 360° about the axis J1. In other words, the contact surface 64*a* of the contact member 64 can be inclined relative to a plane that is vertical to the axis J1 of the spindle 18. In this way, the base 50 and the support member 60, in particular, the spherical convex surface 62*a* and the plurality of spherical concave surface portions 50*a* may serve as an angle variable device for varying an angle of the contact surface 64*a* of the contact member 64 relative to the axis J1 of the spindle 18, i.e., the axis of the driver bit 30. In a different viewpoint, the base 50 and the support member 60 (in particular, the spherical convex surface 62*a* and the plurality of spherical concave surface portions 50*a*) may serve as an orientation adjusting device for adjusting the orientation of the contact member 64 relative to the main body 2 or the axial direction of the driver bit 30 such that the contact surface 64*a* extends substantially parallel to the surface of the workpiece as will be explained later. Further, in this embodiment, the tilting movement of the contact member 64 is limited within a predetermined angular range permitted by the O-ring 72 that may be elastically deformed when the tilting movement occurs. In addition, no tilting movement of the contact member 64 occurs when no external load is applied to the contact member 64 in the tilting direction. Thus, the O-ring 72 normally holds the contact member 64 in an initial position where the contact surface 64*a* of the contact member 64 extends within a plane that is perpendicular to the axis J1 of the spindle 18 (i.e., the axis of the driver bit 30). In this way, the O-ring 72 serves as an elastic holding device for elastically holding the contact member 64 such that contact surface 64*a* of the contact member 64 extends substantially perpendicular to the axis J1 of the spindle 18, i.e., the axis of the driver bit 30.

A screw driving operation performed by the electric screwdriver 1 will now be described. First, the operator may adjust the position of the locator 40 in the front-to-rear direction by rotating the adjusting ring 32, so that the protruding distance of the driver bit 30 from the contact surface 64*a* of the contact member 64 can be adjusted. After that, the operator may attach a screw (not shown) to the driver bit 30 and may operate (pull) the trigger 34 for starting the electric motor 12. In this state, although the rotation of the electric motor 12 may be transmitted to the reduction gear 16, the clutch device 20 interrupts the transmission of rotation of the reduction gear 16 to the spindle 18. For driving the screw into a workpiece, the operator may hold the electric screwdriver 1 to press the screw against the workpiece. Then, the spindle 18 moves rearward against the biasing force of the spring 21, so that the clutch device 20 operates to transmit rotation of the reduction gear 16 to the spindle 18. Therefore, the driver bit 30 attached to the spindle 18 rotates together with the spindle 18 to drive the screw into the workpiece.

Figure 8:
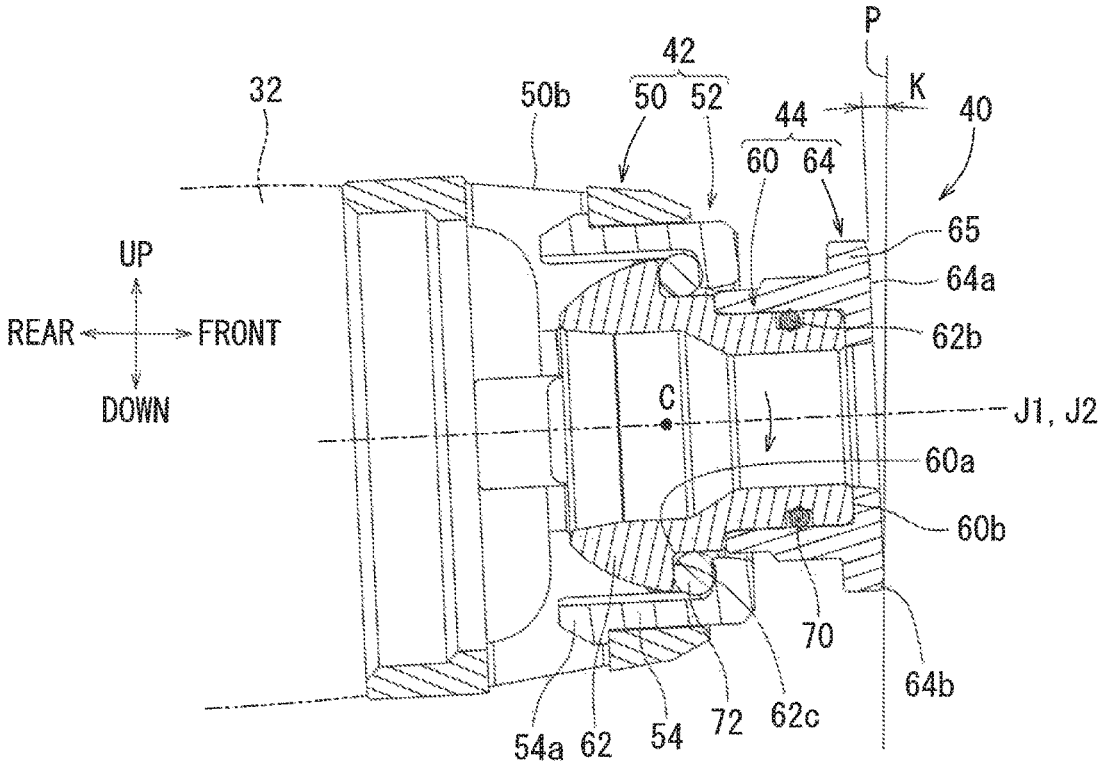
FIG. 8 is a view similar to FIG. 7 but showing a state where a contact surface of a contact member of the locator is in a partial contact with a surface of a workpiece.
Figure 9:
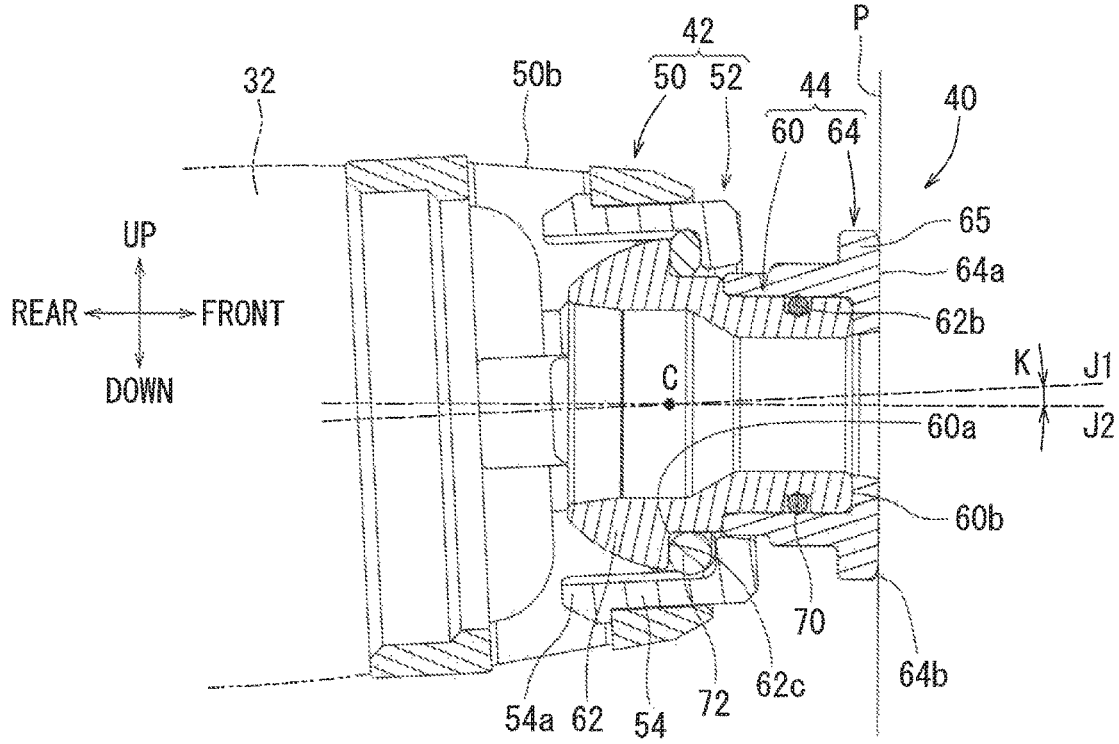
FIG. 9 is a view similar to FIG. 8 but showing a state where the contact member has been tilted such that the entire contact surface contacts the surface of the workpiece.
Figure 10:
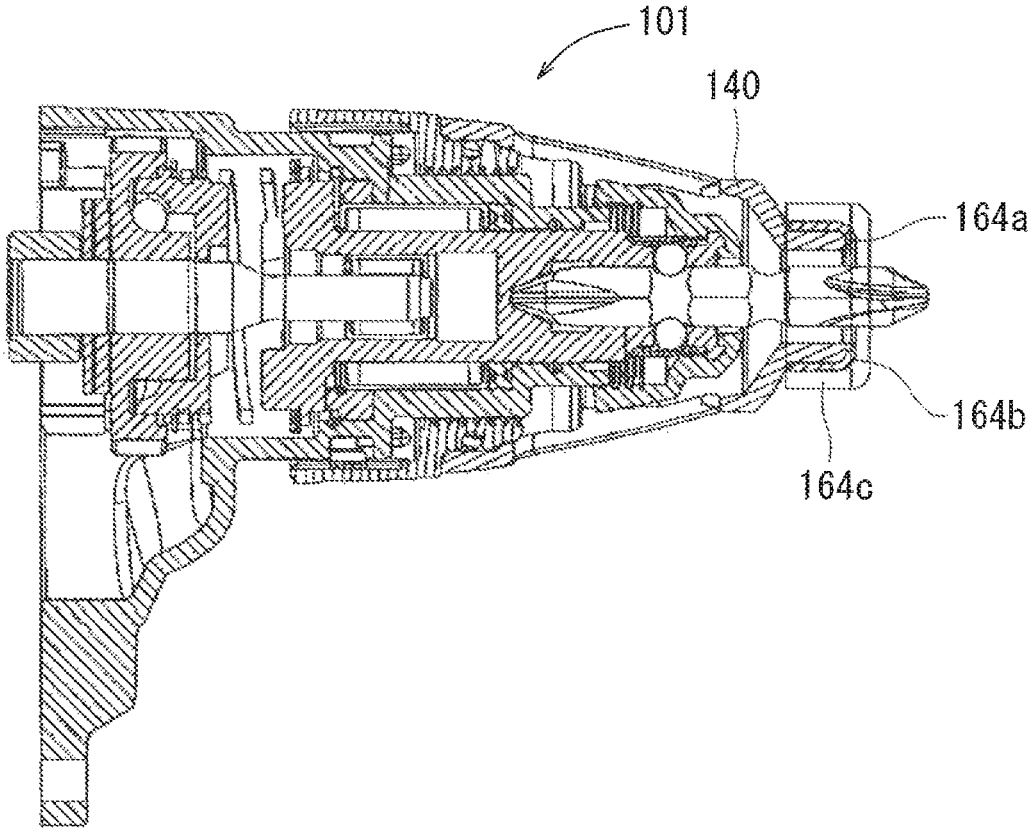
FIG. 10 PRIOR ART
FIG. 10 is a vertical sectional view of a front portion of a known electric screwdriver.

As the screw is driven into the workpiece, the contact surface 64*a* of the contact member 64 may contact the workpiece. After that, the spindle 18 rotates further to drive the screw until the screw is driven by the predetermined driving depth. During this operation, it may be possible that a partial contact of the contact surface 64*a* occurs as shown in FIG. 8. Thus, the contact surface 64*a* of the contact member 64 may contact the surface of a workpiece P only at a part of a peripheral edge 64*b* of the contact surface 64*a* for the first time due to inclination of the contact surface 64*a* relative to the surface of the workpiece P by an angle K (i.e., due to inclination of the axis J1 of the spindle 18 by the angle K relative to a direction perpendicular to the surface of the workpiece P). However, as operator moves the electric screwdriver 1 further toward the workpiece P, the reaction force applied to the contact member 64 by the workpiece P may cause the contact member 64 to rotate (tilt) relative to the holder 52 (i.e., relative to the spindle 18) in the clockwise direction as shown in FIG. 8, while the O-ring 72 is elastically deformed. As a result, the contact member 64 may be automatically rotated (tilted) by the same angle as the angle K, so that the entire contact surface 64*a* may contact the surface of the workpiece P as shown in FIG. 9. In this way, the contact member 64 can rotate (tilt) relative to the spindle 18 until the entire contact surface 64*a* contacts the surface of the workpiece P. In other words, the orientation of the contact member 64 relative to the surface of the workpiece P may be adjusted. When the screw has been driven by the predetermined driving depth, the clutch device 20 may be operated to interrupt transmission of rotation of the reduction gear 16 to the spindle 18. Thus, the rotation of the spindle 18 may be stopped to complete the driving operation. In this way, the locator 40 may adjust the driving depth of the screw according to the position of the contact surface 64*a* of the contact member 64 relative to the spindle 18 or the driver bit 30 in the axial direction. When the electric driver 1 is moved away from the workpiece P after compression of the driving operation, the contact member 64 may tilt in the opposite direction by the same angle as the angle K to return to its original position by the elastic force of the O-ring 72. In this way, the O-ring 72 serves as an elastic holding device that normally holds the contact member 64 to be coaxial with the spindle 18, while allowing the tilting movement of the contact member 64 within a predetermined angular range through elastic deformation.

As described above, according to the electric screwdriver 1 of this embodiment, even in the case where the contact surface 64*a* of the contact member 64 of the locator 40 contacts the workpiece P in a partial contact manner for the first time, the contact member 64 may automatically tilt (or adjust its orientation relative to the main body 2 or the axial direction of the driver bit 30) such that the entire contact surface 64*a* contacts the surface of the workpiece P as the electric screwdriver 1 is pressed against the workpiece P. Therefore, it is possible to prevent potential damage to the workpiece P. Thus, a crescent-shaped depression may not be formed in the surface of the workpiece P by the peripheral edge 64*b* of the contact member 64. Further, it is not necessary to provide a cover for covering the peripheral edge 64*b* of the contact member 64 for preventing potential damage to the workpiece P.

Furthermore, the contact member 64 is tiltable to vary the angle of the contact surface 64*a* relative to the axis J1 of the spindle 18, i.e., the axis of the driver bit 30 at any position throughout 360° about the axis J1, i.e., the axis of the driver bit 30. Therefore, the contact member 64 can tilt when the contact surface 64*a* contacts the workpiece P at any part of the peripheral edge 64*b* in the circumferential direction. In other words, the contact member 64 can tilt when the axis of the driver bit 30 is inclined relative to the plane perpendicular to the surface of the workpiece P in any direction.

Furthermore, the contact member 64 can tilt through sliding movement between the plurality of spherical concave surface portions 50*a* of the base 50 and the spherical convex surface 62*a* of the support member 60 of the contact support structure 44. In other words, the base 50 and the support member 60 are coupled to each other through a spherical surface joint structure. This joint structure may have a simple construction in comparison with a joint structure having two rotational axes extending perpendicular to each other.

Furthermore, in the above embodiment, the outer diameter D2 of the front portion (i.e., the flange portion 65) of the contact member 64 having the contact surface 64*a* is larger than the outer diameter D1 of the remaining portion of the contact member 64 (see FIG. 6). Therefore, it is possible to ensure a relatively large area for the contact surface 64*a*. As a result, the operator can hold the electric screwdriver 1 in stable after the entire contact surface 64*a* contacts the workpiece P as a result of the tilting movement.

Furthermore, the contact member 64 is detachable from the support member 60. Therefore, the contact member 64 can be replaced with another contact member, for example, in the case where the contact member 64 has be accidentally damaged.

Furthermore, in the above embodiment, four engaging holes 50*b* of the base 50 are arranged such that each of the spherical concave surface portions 50*a* is arranged between two engaging holes 50*b* positioned adjacent to each other in the circumferential direction. Therefore, the joint structure may have a compact construction.

The above embodiment may be modified in various ways. For example, although the outer diameter D2 of front portion of the contact member 64 is larger than the outer diameter D1 of the remaining portion of the contact member 64 (see FIG. 6), it may be possible to set the outer diameter D2 to be the same as the outer diameter D1.

Further, although the contact member 64 is made from a synthetic resin having a relatively high rigidity, it may be possible to make the contact member 64 from any other material. For example, the contact member 64 may be made from metal, such as aluminum or iron, or may be made from a synthetic resin having a relatively low rigidity, such as elastomer or rubber. It may be also possible to prepare a plurality of contact members 64 that are made from different materials and can be exchangeably used. For example, a first contact member made from polypropylene (synthetic resin having a relatively high rigidity), a second contact member made from elastomer (i.e., synthetic resin having a relatively low rigidity) or a rubber, a third contact member made from aluminum, and a fourth contact member made from iron may be exchangeably used, for example, depending on the material of the workpiece P or the purpose of use of the workpiece P.

For example, if the workpiece P is a base material to be covered by a finishing material, such as a wallpaper, the third contact member made from aluminum or the fourth contact member made from iron may be used. Thus, if the third or fourth contact member is used, it may be possible that a dark-colored mark is left on the surface of the workpiece P through contact therewith. However, such a dark-colored mark may be hidden by the finishing material. The use of the third or second contact member made from metal is advantageous because it has a relatively high durability. On the other hand, if the surface of the workpiece P is a finished surface, the first contact member or the second contact member made from synthetic resin or rubber may be advantageously used because it does not leave a dark-colored mark on the workpiece P.

Furthermore, in the above embodiment, four engaging holes 50*b* of the base 50 are arranged to be space equally from each other in the circumferential direction of the base 50 (i.e., at an interval of 90°). Similarly, four elastically deformable extensions 54 are arranged to be spaced equally from each other in the circumferential direction of the holder 52. However, the number of the engaging holes 50*b*, which may be equal to the number of the elastically deformable extensions 54, may not be limited to four but may be one, two, three or five or more.

Furthermore, in the above embodiment, the base 50 has the plurality of spherical concave surface portions 50*a*, while the support member 60 has the spherical convex surface 62*a*. However, this arrangement may be reversed such that the base 50 has a spherical convex surface, while the support member 60 has a plurality of spherical concave surface portions.

Furthermore, although the locator 40 includes the locator body structure 42 and the contact member structure 44 in the above embodiment, the locator 40 may include only the contact member structure 44. In such a case, the support member 60 of the contact member structure 44 may be modified to be directly joined to the adjusting ring 32, for example, via a joint structure having two rotational axes extending perpendicular to the axis of the adjusting ring 32.

Furthermore, in the above embodiment, the locator 40 is attached to the front end of the adjusting ring 32, and the adjusting ring 32 is threadably engaged with the outer surface of the front end of the housing 10. However, it may be possible that the locator 40 is directly threadably engaged with the outer surface of the front end of the housing 10.

Furthermore, the O-ring 72 may be replaced with any other ring-shaped member having a different cross sectional shape, such as a rectangular-shape, from a circular shape.

Further, in the above embodiment, the O-ring 72 is used as an elastic holding device that normally holds the contact member 64 to be coaxial with the spindle 18, while allowing the tilting movement of the contact member 64 within a predetermined range through elastic deformation. However, it may be possible to use springs, such as coil springs or leaf springs, as the elastic holding device.

Furthermore, although the above embodiment has been described in connection with the electric screwdriver 1 driven by the motor 12, the above teachings may be applied to any other power screwdrivers having different drive devices from the motor 12, such as a pneumatically driven screwdriver and an engine-driven screwdriver.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved power screwdrivers, and methods of making and using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

What is claimed is:

1. An electric screwdriver comprising:

a main body including a housing;

a bit drive device including an electric motor disposed within the main body and configured to rotate a driver bit;

wherein the driver bit extends in an axial direction within the housing and is configured to be capable of attaching a screw thereto;

a locator attached to the housing and configured to adjust a driving depth of the screw into a workpiece;

wherein the locator comprises a contact member having a contact surface configured to contact the workpiece, so that the screw is driven into the workpiece by a predetermined depth determined by a position of the contact surface of the contact member relative to the driver bit in the axial direction; and an angle variable device configured to vary an angle of the contact surface of the contact member relative to the axial direction of the driver bit about a point positioned on an axis of the driver bit, thereby enabling an orientation of the contact member relative to the main body to be automatically adjusted by utilizing a reaction force applied to the contact member when the contact surface of the contact member contacts a surface of the workpiece.

2. The electric screwdriver according to claim 1, wherein:

the bit drive device is further configured to interrupt transmission of rotation of the electric motor to the driver bit when the screw has been driven into the workpiece by the predetermined depth while the contact surface of the contact member is in contact with the workpiece.

3. The electric screwdriver according to claim 1, wherein:

the angle variable device is configured to vary the angle of the contact surface of the contact member in any of directions about the axial direction of the driver bit.

4. The electric screwdriver according to claim 3, wherein:

the locator comprises a locator body structure and a contact member structure;

the locator body structure is attached to the housing of the main body;

the contact member structure comprises the contact member;

the contact member structure is coupled to the locator body structure via the angle variable device;

the angle variable device comprises a spherical convex surface structure and a spherical concave surface structure slidably contact with each other along a spherical plane.

5. The electric screwdriver according to claim 4, wherein:

the contact member structure further comprises a support member that is coupled to the locator body structure via the angle variable device; and the contact member is detachably attached to the support member.

6. The electric screwdriver according to claim 5, wherein:

the electric screw driver comprises a plurality of contact members made from different materials from each other and selectively attached to the support member.

7. The electric screwdriver according to claim 4, wherein:

the spherical convex surface structure of the angle variable device is disposed at the contact member structure;

the locator body structure comprises a base and a holder;

the spherical concave surface structure of the angle variable device is disposed at the base;

the spherical concave surface structure comprises a plurality of spherical concave surface portions arranged in a circumferential direction of the base;

the base further comprises a plurality of engaging holes arranged alternately with the plurality of spherical concave surface portions in the circumferential direction; and the holder is configured to hold the contact member structure with respect to the base and includes a plurality of engaging claws configured to engage the plurality of engaging holes.

8. The electric screwdriver according to claim 1, further comprising an elastic holding device configured to elastically hold the contact member such that the contact surface of the contact member extends substantially perpendicular to the axial direction of the driver bit.

9. A power screwdriver comprising:

a main body including a bit drive device configured to rotate a driver bit, the driver bit being configured such that a screw can be attached thereto;

a locator attached to the main body and configured to adjust a driving depth of the screw into a workpiece;

wherein the locator comprises a contact member including a contact surface configured to contact a surface of the workpiece; and an orientation adjusting device configured to adjust an orientation of the contact member relative to the main body about a point positioned on an axis of the driver bit, thereby enabling the orientation of the contact member relative to the main body to be automatically adjusted by utilizing a reaction force applied to the contact member when the contact surface of the contact member contacts the surface of the workpiece.

10. The power screwdriver according to claim 9, wherein:

the orientation adjusting device is further configured to adjust the orientation of the contact member such that the contact surface extends substantially parallel to the surface of the workpiece.

11. The power screwdriver according to claim 10, wherein:

the orientation adjusting device is further configured to couple the contact member to the main body such that the contact member is tillable relative to driver bit.

12. The power screwdriver according to claim 11, wherein:

the orientation adjusting device is further configured to couple the contact member to the main body such that the contact member is tiltable relative to the driver bit about the point positioned on an axis of the driver bit.

13. The power screwdriver according to claim 12, wherein:

the orientation adjusting device comprises a concave surface structure and a convex surface structure slidably movable relative to each other along a spherical plane with a center defining the tilting point.

14. An electric screwdriver comprising:

a main body including a housing;

a bit drive device including an electric motor disposed within the main body and configured to rotate a driver bit;

wherein the driver bit extends in an axial direction within the housing and is configured to be capable of attaching a screw thereto;

a locator attached to the housing and configured to adjust a driving depth of the screw into a workpiece;

wherein the locator comprises a contact member having a contact surface configured to contact the workpiece, so that the screw is driven into the workpiece by a predetermined depth determined by a position of the contact surface of the contact member relative to the driver bit in the axial direction; and an angle variable device configured to vary an angle of the contact surface of the contact member relative to the axial direction of the driver bit in any direction about the axial direction of the driver bit, the angle variable device comprising a spherical convex surface structure and a spherical concave surface structure that slidably contact with each other along a spherical plane.

* * * * *